United States Patent [19]

Hunger et al.

[11] 4,138,105

[45] Feb. 6, 1979

[54] RESPIRATORY EXERCISER

[75] Inventors: Darrell M. Hunger, Oakland; Lee E. McGill, Albany; Raymond D. von Alven, San Raphael, all of Calif.

[73] Assignee: Cutter Laboratories, Inc., Berkeley, Calif.

[21] Appl. No.: 772,614

[22] Filed: Feb. 28, 1977

[51] Int. Cl.[2] ..... A63B 23/00

[52] U.S. Cl. ..... 272/99; 128/2.08

[58] Field of Search ..... 272/99; 128/2.08; 73/205 L, 211, 239, 209, 290 R, 299, 302, 305, 306, 309, 311, 317, 322, 323, 379, 419; 46/44; 222/51, 155; 116/109, 110, 118 R, 117 R, 117 C, 117 B

[56] References Cited

U.S. PATENT DOCUMENTS

| | | | |
|---|---|---|---|
| 2,400,261 | 5/1946 | Plebanek | 46/44 X |
| 3,695,608 | 10/1972 | Hanson | 272/99 |
| 4,025,070 | 5/1977 | McGill et al. | 272/99 |
| 4,060,074 | 11/1977 | Russo | 272/99 X |
| 4,086,918 | 5/1978 | Russo | 272/99 X |

FOREIGN PATENT DOCUMENTS

| | | | |
|---|---|---|---|
| 1016678 | 9/1952 | France | 128/2.08 |

*Primary Examiner*—Richard J. Apley

*Attorney, Agent, or Firm*—Robert E. Allen; James A. Giblin; Bertram Bradley

[57] ABSTRACT

The device comprises a closed container with a breathing tube and a means for variably adjusting the size of an aperture into the container. A transparent inclined tube is mounted on the container and houses a moveable air flow indicating member. The tube has a passage at the top leading into the container and a vent at the bottom of the tube allows air to enter to move the flow indicating member up the inclined tube. Air drawn from the container by inspiring through the breathing tube is replaced in part by air entering through the variable aperture means and by the air entering through the vent. By adjusting the size of the variable aperture, one can determine inspiratory capacity as correlated with the amount of air necessary to move the flow indicating member to the top of the tube or to an intermediate position in the tube.

11 Claims, 8 Drawing Figures

RESPIRATORY EXERCISER

BACKGROUND OF THE INVENTION

This invention relates to a respiration exercising device and in particular to a device for enhancing inspiration for improvement of pulmonary performance.

One of the main causes for slow recovery of post-operative patients has been inadequate oxygen exchange in the lungs resulting from shallow breathing accompanying the use of general anesthesia. This condition can lead to partial or complete collapse of the lungs and to pneumonia.

Various methods have been proposed for preventing such pulmonary complications including instructions to the patient to breathe deeply, coughing exercises, and the use of blow bottles or the like to enhance expiration. Such methods of lung exercise have not been too successfull since the alveoli are not adequately expanded.

Recognizing the greater benefits from methods employing positive pressure breathing, i.e., dilating bronchi and expanding unventilated alveoli by positive inhalation, several devices have been introduced to stimulate the patient in improving his inspiratory capacity. One such device currently in use consists of three light weight balls each contained in three vertical tubes interconnected at their tops and with a vent at the bottom of each tube. When a patient inhales through a breathing tube attached to the first tube, one or more balls will rise to the top of their respective tubes depending upon the strength of the inhalation. Although this device is inexpensive and disposable, it lacks versatility since it has the capability for measuring only three values of inspiratory capacity.

Another such device which has recently become available comprises a breathing tube connected to a closed container with a vertical tube resting on the container and housing an air floatable ball. The top of the tube has an air passage in communication with the container and an air vent at the base of the tube. A dial on the container provides means for varying the size of an aperture into the container which regulates the amount of air flowing through the vent causing the ball to rise to the top of the vertical tube when the patient inspires through the breathing tube. Although this device is somewhat more versatile than the model employing three balls in terms of indicating inspiratory capacities, each depends on the ball float rising to the top of a tube as an indication of a specific volume in the patent's inspiratory capacity. No accurate indication of capacities which are intermediate between dial settings are possible, i.e., where the ball is supported by flow of air through the vent so that it rises only part way up a tube on which indicia may be marked, since the ball cannot be maintained in a steady condition, tending to "bounce" up or down so that reading the position of the ball with any degree of accuracy is not possible.

It is therefore an object of the present invention to provide an improved respiratory exerciser which assists an individual in increasing his inspiratory capacity and permits him to measure easily and accurately said capacity over a wide range of values.

SUMMARY OF THE INVENTION

The device of the present invention comprises a hollow container on which is mounted an inclined tube housing a light weight air flow indicating member such as a ball or cylinder whose diameter is less than the diameter of the tube. The top of the inclined tube has an opening communicating with the interior of the container either by means of a conduit, or in a preferred embodiment, by extending the container upwardly at one end so as to meet the top of the inclined tube. A second opening into the container has variable aperture means for adjusting the size of the second opening whereby different inspiratory capacities are imposed on the user. A third opening into the container is associated with a breathing tube. Vent means at the base of the inclined tube allows air entering the inclined tube during an inspiration to roll the ball or push the cylinder in an even, steady manner up the incline, either to the top of the tube or to any intermediate point. The volume of air passing into the container on each inspiration is proportioned between that flowing through the vent means and that flowing through the variable aperture means. The larger the opening in the latter, the greater the amount of air which will flow therethrough and the lesser the amount which flows through the vent means. This makes it more difficult for the patient to move the ball or cylinder up into the tube. Conversely, the smaller the opening in the variable aperature means, the easier it will be to move the ball or cylinder.

By being on an incline, the ball or cylinder is prevented from moving erratically as it is lifted upwardly by air since a portion of its surface is constantly in contact with a base of the inclined tube. The ball, in fact, rolls steadily up the incline. The position of the ball or cylinder can be easily and accurately noted at any point so that inspiratory capacities can be determined which are intermediate in value between any two adjacent settings of the variable aperture means.

The invention will be better understood and additional objects and advantages will become apparent from the following description of the preferred embodiments and as illustrated in the drawings.

DESCRIPTION OF PREFERRED EMBODIMENTS

Figure 1:
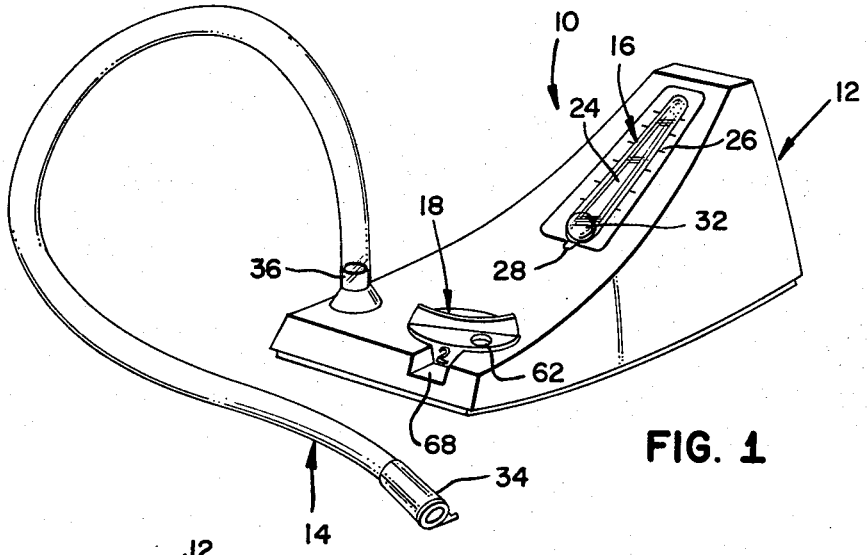
FIG. 1 is a perspective view of a preferred embodiment of the respiratory exercising device of the present invention.
Figure 2:
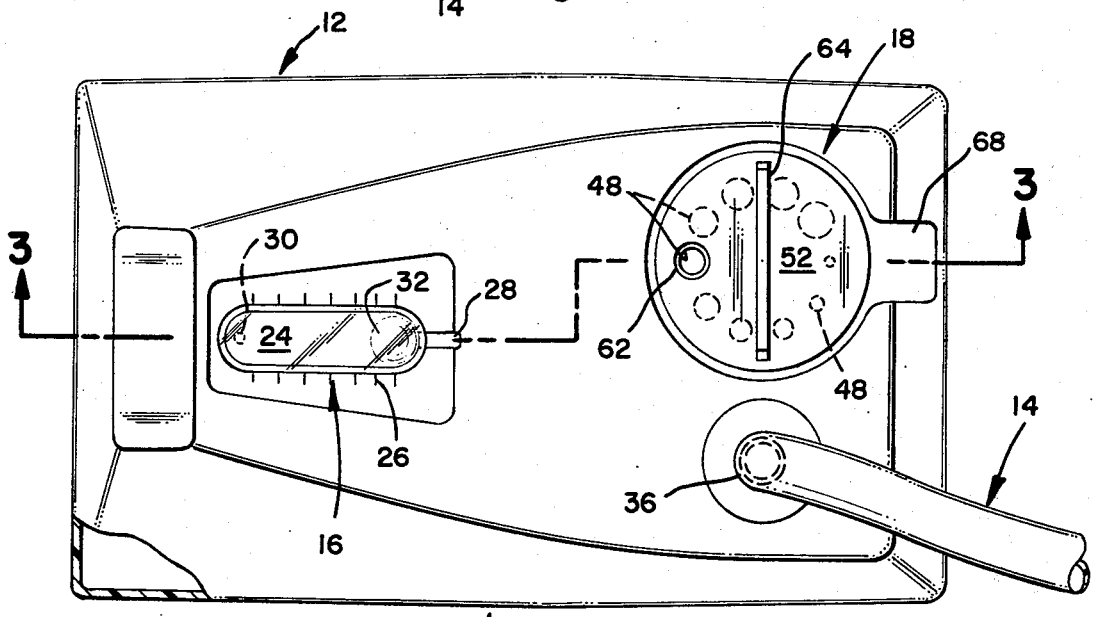
FIG. 2 is a plan view of the device of FIG. 1 showing details of the variable aperture means in phantom.
Figure 3:
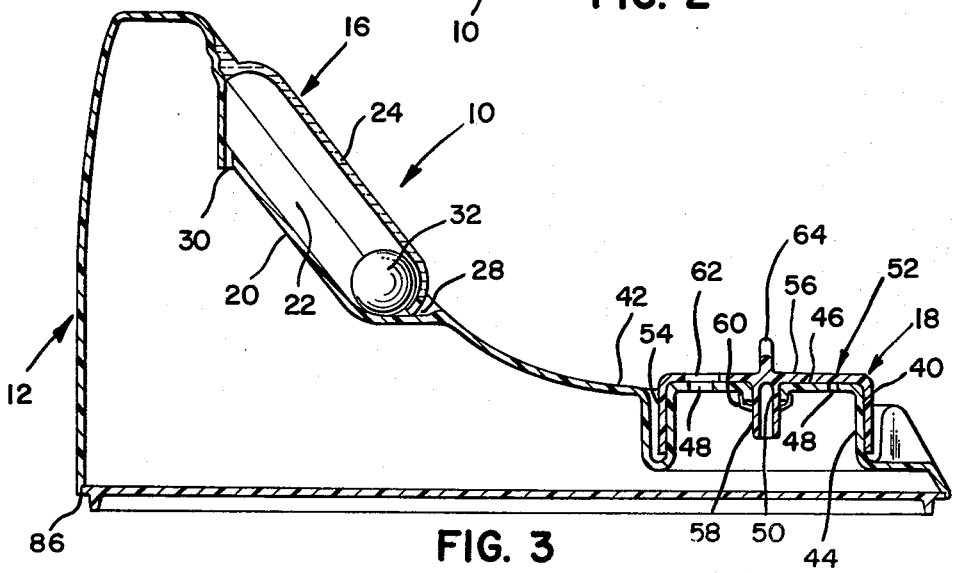
FIG. 3 is a side view in cross section of the device of FIG. 2 taken along line 3—3.
Figure 4:
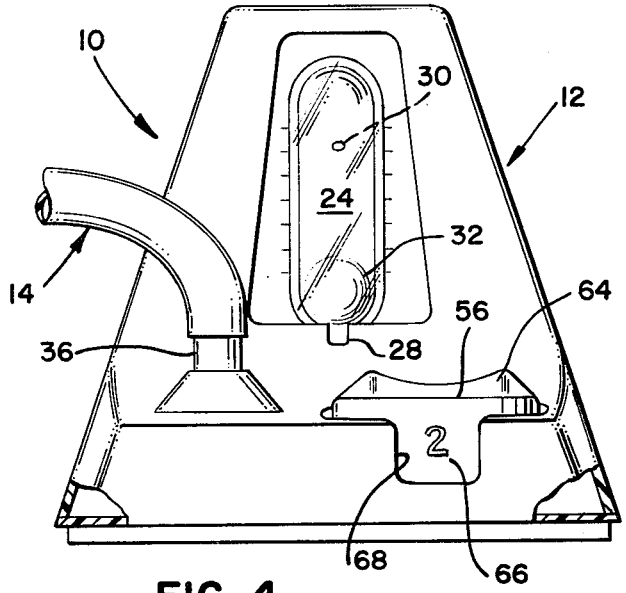
FIG. 4 is an end view of the device of FIG. 2.

Referring to FIGS. 1–4, a respiratory exercising device 10 is shown which includes a closed container 12 on which are mounted a breathing tube 14, an air capacity indicator tube 16, and a variable aperture assembly 18.

In this particular embodiment, the container 12 is generally rectangular having one end somewhat shallow on which the breathing tube 14 and the variable aperture assembly 18 are mounted. The other end is deeper so as to provide an upwardly sloping surface 20 intermediate between these two ends. Air capacity indicator tube 16 lies on this sloping surface 20 and is formed in part by a trough-like surface 22 recessed into surface 20 and in part by a transparent rounded capsule 24 sealed at its edges to edges of trough 22. Indicia 26 are spaced on surface 20 adjacent tube 16. Alternatively, indicator tube 16 may comprise a unitary tubular member secured to the sloping surface 20.

Figure 8:
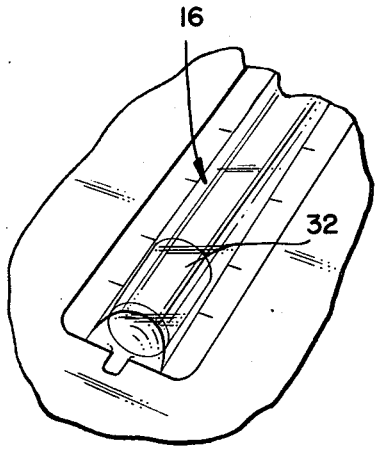
FIG. 8 is a view in perspective of a portion of the inclined tube housing a cylindrical shaped member in place of a ball as used in the device of this invention.

Located at the lower end of tube 16 is a vent 28 for the purpose of allowing air to flow into indicator tube 16. A hole 30 at the upper end of tube 16 opens into container 12. Housed within tube 16 is an air flow indicating member 32 which, in this embodiment, is a ball of light weight material with a diameter somewhat less than the inside diameter of tube 16. Member 32 can also be in the shape of a cylinder such as that shown in FIG. 8 or it can be any other shape as long as it is readily responsive to a flow of air into tube 16 so as to rise upwardly through tube 16 easily and smoothly.

The angle at which tube 16 is placed in relation to the base of container 12 is not critical as long as it is not vertical or so small that the incline surface 20 of tube 16 cannot provide a reasonable resistance against the ball or cylinder 32. Preferably the angle should be approximately in the range between 30° and 75°.

The breathing tube 14 has a mouthpiece 34 at one end and its other end is connected to a tubular port 36 which opens into container 12.

As shown in FIGS. 1–4, variable aperture assembly 18 comprises a circular base portion 40 recessed into and contiguous with top surface 42 of container 12 so as to form side wall 44 and a flat upper wall 46. A plurality of holes 48 having progressively increasing diameters are arranged in a circumferential manner in upper wall 46 and the center of each hole 48 is spaced equidistantly from the middle of an opening 50 located at the center of base portion 40. A circular cap 52 having a side wall 54 and an upper wall 56 sealingly and slidingly engages the side wall and upper wall of base portion 40. Cap 52 has a post 58 which slidingly fits into opening 50 of base portion 40 and is retained by clip 60. An aperture 62 is located in upper wall 56 of cap 52, its diameter being substantially the same as that of the largest hole 48. Aperture 62 is spaced so that its center coincides with the center of any hole 48 when cap 52 is rotated. Projection 64 on the top of cap 52 provides a handle for rotating cap 52. Numbers 66 are spaced along side wall 54 of cap 52 to mark off the positions of holes 48 in upper wall 46. A viewing slot 68 formed by a cut-away section in side wall 44 allows one to see numbers 66.

Figure 5:
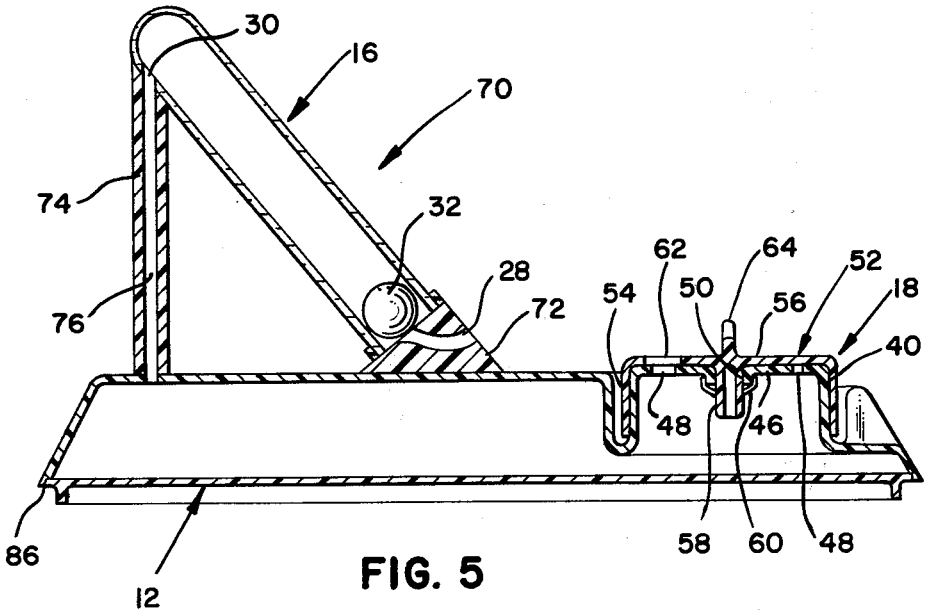
FIG. 5 is a cross sectional view of another embodiment of the respiratory exerciser of this invention.

In another embodiment 70 of the device of this invention, illustrated by FIG. 5, container 12 is not raised at one end and is generally more or less flat along its upper surface. Indicator tube 16 is secured on an inclined position to container 12 by support member 72 at the lower end of tube 16. The upper end of tube 16 is supported by conduit 74 which also provides a passageway 76 or air flow communication between the interior of container 12 and tube 16. In all other respects, this embodiment is like device 10.

Figure 6:
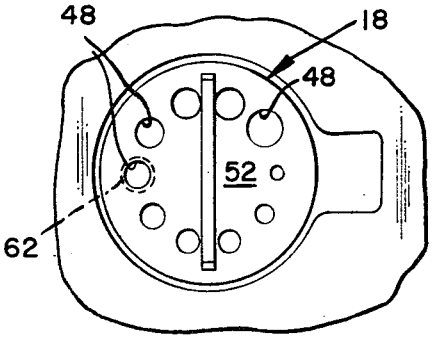
FIG. 6 is a fragmentary plan view showing another version of the variable aperture means in the device of this invention.
Figure 7:
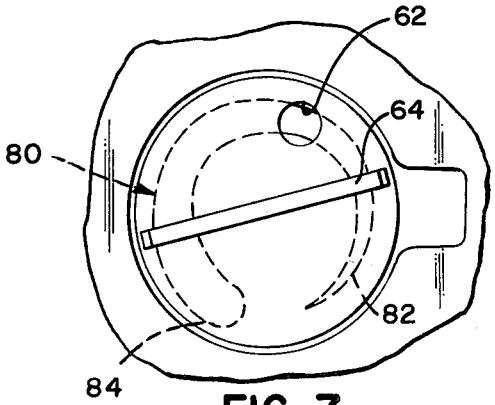
FIG. 7 is a fragmentary plan view of still another version of the variable aperture means in the device.

The variable aperture assembly can have other forms as long as it provides a means for forming an aperture into container 12 which can be selectively varied in size. One such modification is shown in FIG. 6 wherein the plurality of holes 48 are located in the upper wall 56 of cap 52 and the aperture 62 is located in upper wall 46 of base 40. Still another modification of variable aperture assembly 18 (see FIG. 7) comprises a circular slot 80 in upper wall 46 which is narrow at one end 82 and progressively widens to the other end 84. Cap 52 has an aperture 62 whose diameter is substantially the same as the width of slot 80 at end 84.

The respiratory exerciser of this invention can be made of any rigid material, preferably of a plastic which can be readily molded and sealed by heat or solvent welded. The container 12 can be formed conveniently by molding it in two parts and subsequently joining these two parts as at junction 86 after first installing cap 52 and clip 60.

In operation, handle 64 if rotated to line up a particular numeral 66 as viewed through slot 68. A patient is instructed to exhale, close his mouth about the mouthpiece 34 and inhale gradually but forcibly through the mouthpiece. Air from the exterior is drawn through opening 28 in tube 16 as a result of air being withdrawn from tube 16 through opening 30 and container 12 by the inspiration of air into the patient's lungs. A portion of the air is also drawn through hole 48, the amount depending on the size of hole 48. That portion of air which enters vent 28 causes the ball or cylinder 32 to rise upwardly in tube 16. The patient is usually instructed to start with a setting of the variable aperture where he is just able to make the ball or cylinder 32 rise to the top of tube 16 and hold it there a prescribed period of time. If he is not able to reach the top at that setting, then he may evaluate his present inhalation capacity by raising the member 32 to some intermediate position as marked by indicia 26. Thus the respiratory exerciser of this invention provides means for measuring accurately a greatly expanded number of inspiratory capacities.

We claim:

1. A respiratory exercising device comprising:

a. a closed container, b. a transparent hollow tubular column fixedly associated with the container and angularly inclined in an upwardly direction with respect to the base of the container, said column having vent means at its lower end and a passageway at its upper end in communication with a first opening in the container, c. variable aperture means for selectively regulating flow of air into the container, d. a breathing tube in communication with a second opening in the container; and e. an air flow indicating member within said column, and adapted for movement in an upwardly direction in response to air flowing through said vent means into said column as a consequence of inhaling through said breathing tube.

2. The device of claim 1 wherein the upper surface of the container slopes upwardly from a lower end to a higher end, the hollow tubular column conforming generally to the sloping surface.

3. The device of claim 1 wherein the upper surface of the container is generally flat, the lower end of the inclined column being proximate the upper surface, the passageway at the upper end of the inclined column communicating with the first opening comprising a conduit extending from the upper end of the column to the upper surface of the container.

4. The device of claim 1 wherein said variable aperture means comprises a base portion on the container and a cap member slidingly mounted on the base portion, one of the base portion and the cap member having variable hole means and the other having an aperture of constant size, the cap member and the base portion being in a relationship whereby the constant sized aperture registers with a portion of the variable hole means.

5. The device of claim 4 wherein the variable hole means comprises a plurality of holes varying in size and the constant sized aperture is at least as large as the largest hole of the plurality of holes.

6. The device of claim 5 wherein the plurality of holes are arranged circularly.

7. The device of claim 6 wherein the circularly arranged holes are located in the base portion and the constant sized aperture is located in the cap member, the constant sized aperture being adapted for registering with one of the holes while the cap member closes off the remainder of the holes.

8. The device of claim 6 wherein the circularly arranged holes are located in the cap member and the constant sized aperture is located in the base portion, the constant sized aperture being adapted for registering with one of the holes while the base portion seals the remainder of the holes.

9. The device of claim 4 wherein the variable hole means comprises a slot progressively increasing in width from one end to the other and the constant sized aperture is at least as wide as the widest portion of the slot.

10. The device of claim 9 wherein the slot is substantially circular.

11. The device of claim 10 wherein the slot is located in the cap member and the constant sized aperture is located in the base portion, the constant sized aperture being adapted for registering with a portion of the slot while the base portion seals the remainder of the slot.

* * * * *